US006570308B1

(12) United States Patent
Helbig et al.

(10) Patent No.: US 6,570,308 B1
(45) Date of Patent: May 27, 2003

(54) ELECTRIC LAMP

(75) Inventors: Peter Helbig, Sontheim (DE); Hans Wild, Gerstetten (DE); Gerhard Behr, Altheim (DE)

(73) Assignee: Patent-Treuhand-Gesellschaft für Elektrische Glüelampen mbH, München (DE)

( * ) Notice: Subject to any disclaimer, the term of this patent is extended or adjusted under 35 U.S.C. 154(b) by 30 days.

(21) Appl. No.: 09/787,177

(22) PCT Filed: Jul. 5, 2000

(86) PCT No.: PCT/DE00/02205

§ 371 (c)(1),
(2), (4) Date: Mar. 14, 2001

(87) PCT Pub. No.: WO01/11649

PCT Pub. Date: Feb. 15, 2001

(30) Foreign Application Priority Data

Aug. 4, 1999 (DE) ..... 199 36 619

(51) Int. Cl.[7] ..... H01J 5/48

(52) U.S. Cl. ..... 313/318.09; 313/318.1; 313/318.11; 313/318.05

(58) Field of Search ..... 313/318.09, 318.1, 313/318.11, 318.05

(56) References Cited

U.S. PATENT DOCUMENTS

| | | | | |
|---|---|---|---|---|
| 4,879,491 A | * | 11/1989 | Hirozumi et al. | 313/318.09 |
| 5,320,539 A | | 6/1994 | Haskins | |
| 5,513,082 A | | 4/1996 | Asano | |

FOREIGN PATENT DOCUMENTS

| | | |
|---|---|---|
| DE | 86 15 923.2 | 7/1986 |
| DE | 197 52 979 A1 | 6/1999 |
| EP | 0 490 702 | 6/1992 |
| EP | 0 684 669 A2 | 11/1995 |
| EP | 0 989 591 | 3/2000 |

* cited by examiner

*Primary Examiner*—Sandra O'Shea
*Assistant Examiner*—Sumati Krishnan
(74) *Attorney, Agent, or Firm*—Frishauf, Holtz, Goodman & Chick, P.C.

(57) ABSTRACT

An electric lamp with a base (6), which is structurally subdivided into an upper part (7) that retains the bulb and a substantially circular-cylindrical lower part (5) for external fastening, which lower part protrudes past the upper part, and the protruding portion (13) is embodied as a detent mechanism for the external fastening. The detent mechanism in each case includes an inward-facing detent protrusion (20) located on the outside, which is an integral component of the lower part, and a metal spring (24), located opposite the detent protrusion and cooperating with it, that is secured in the lower part.

11 Claims, 6 Drawing Sheets

ELECTRIC LAMP

CROSS REFERENCE TO RELATED APPLICATION

This application is a U.S. National Phase Application under 35 USC 371 of International Application PCT/DE00/02205 (not published in English) filed Jul. 5, 2000.

FIELD OF THE INVENTION

The present invention relates to an electric lamp and more particularly relates to incandescent bulbs for use in the automotive field, especially in headlights.

BACKGROUND INFORMATION

From International Patent Disclosure WO 99/28949, an electric lamp is already known that is suitable for use both as a turn indicator or brake light in the tail region and as a turn indicator in the front headlight. The lamp uses a base of plastic with fastening tabs integrally formed on in a V, which form a receptacle for a peglike socket or plug part.

A further refinement of this lamp is described in German Patent Application DE-PA 198 43 506. The base has two resilient tabs, each provided with a detent protrusion, and a fastening ring supported rotatably about the annular axis of the base.

OBJECTS AND SUMMARY OF THE INVENTION

It is the object of the present invention to furnish an electric lamp that creates a simple connection which can easily be undone again, and that functions reliably over a long service life. It is a further object of the invention to furnish an electric lamp with an improved lamp base that enables simple mounting of the lamp in the lamp socket.

Initial attempts to make the entire lamp base out of plastic have not proven themselves, because the effect of a plastic detent mechanism decreases over time. This detent mechanism has therefore been improved with the aid of a metal spring. In a first embodiment, a spring wire bent into a clip is advantageously used; the ends of the wire are let into the plastic wall of the base. In a further especially preferred embodiment, a sheet-metal spring embodied as a stamped and bent part is used.

The electric lamp according to the invention has a luminous filament (incandescent body or discharge arc) that is surrounded by a lamp bulb, and also has a lamp base in which the bulb is secured, as well as electrical base contacts and power supply leads for supplying power to the luminous filament.

The base comprises a frustoconical upper part, which surrounds the lamp bottom (typically embodied as a pinch), and a lower part secured to it, which protrudes partly past the circumference of the upper part and which in the region of the protruding portion has two detent mechanisms for fastening in the reflector.

The detent mechanisms each comprise a detent protrusion located on the outside and facing inward, which is an integral component of the lower part and a metal spring located opposite the detent protrusion and cooperating with it and secured in the lower part, the metal spring being suitable for locking in detent fashion in a recess on the reflector, while the detent protrusion is suitable for unlocking this locking of the metal spring again.

The above characteristics make simple mounting of the lamp in a reflector with a neck (or some other fastening means) possible. The locking can be undone again easily and reliably. The lamp is thrust into the reflector as far as the reference plane. After that, still further force must be exerted on the two protruding portions of the base, in order to deform the springs and bring about the locking in recesses of the reflector neck. As a result, force that keeps the lamp in the reflector always prevails at the spring.

In addition, the base on its underside advantageously has a recess for receiving a peglike socket part or plug part. As a result, the lamp of the invention is suitable for mounting on a lamp socket embodied as a plug.

In detail, the present invention relates to an electric lamp, which defines an axis A, having a bulb which contains a luminous filament, and having a base in which the bulb is fixed, the base being provided with external contacts, and having at least two power supply leads which electrically conductively connect the luminous filament to the contacts. The base is subdivided into an upper part, which retains the bulb an essentially circular cylindrical, and a lower part for external fastening, and the lower part protrudes past the upper part and the protruding portion is embodied as a detent mechanism for the external fastening. The detent mechanism in each case comprises a detent protrusion located on the outside and facing inward, which is an integral component of the lower part, and a metal spring located opposite the detent protrusion and cooperating with it and secured in the lower part. The metal spring is suitable for locking in detent fashion in a recess on the reflector, while the detent protrusion is suitable for unlocking this locking of the metal spring again.

The detent protrusion advantageously has a radially inward-pointing projection, which is connected to a base part via two chamfers.

In an especially preferred embodiment, the metal spring comprises a retainer element connected to the lower part of the base via an anchoring means and a spring part formed of two legs, and the retainer element is at least in part located approximately in the plane transverse to the lamp axis. A first, short leg is integrally formed onto the retainer element, and a second, long leg is attached at an acute angle to the free end of the first leg in such a way that it extends approximately parallel to the lamp axis.

In particular, an outward-pointing (away from the axis) projection, located approximately opposite the projection of the detent protrusion, is seated on the free end of the second leg, so that the unlocking is done by pressing the projection of the outer detent protrusion into the recess in which the projection of the second leg is seated.

In a first embodiment of the invention, the metal spring is embodied as a sheet-metal spring part, with a flat base plate transverse to the lamp axis as a retainer element and with a spring part formed in the shape of a V of two legs, and a first, short leg is attached to the base plate and is inclined relative to the base plate. A second, long leg is attached at an acute angle to the first leg and penetrates the plane of the base plate in such a way that it is again oriented approximately parallel to the lamp axis. The anchoring means may be realized by means of bores in the base plate.

In a second embodiment of the invention, the metal spring is embodied as a spring wire piece, and the retainer element has a base part approximately transverse to the lamp axis and the anchoring part is an extension of the base part, which is attached to the base part and is oriented parallel to the lamp axis, and the short leg is bent backward on the base part by more than 120°, in particular by approximately 180°. Preferably, the long leg is attached laterally to the short leg, in particular with an offset bend. This has the advantage that the spring travel distance is lengthened, and furthermore a stabilizing part between symmetrical first legs can be better secured.

Very good results with economical use of material are attained with an embodiment in which the spring wire piece is constructed symmetrically of two halves, both long legs of which are connected to one another via a connecting piece that forms the projection. An especially reliable locking is attained in that the connecting piece has a curved piece bent backward toward the second legs.

The functional safety and reliability is further enhanced by the provision that the two first legs of the symmetrical spring wire piece are connected to one another via a stabilizing part.

BRIEF DESCRIPTION OF THE DRAWINGS

The invention will be described in further detail below in terms of a plurality of exemplary embodiments. Shown are.

DETAILED DESCRIPTION OF THE PREFERRED EMBODIMENT

Figure 1A:
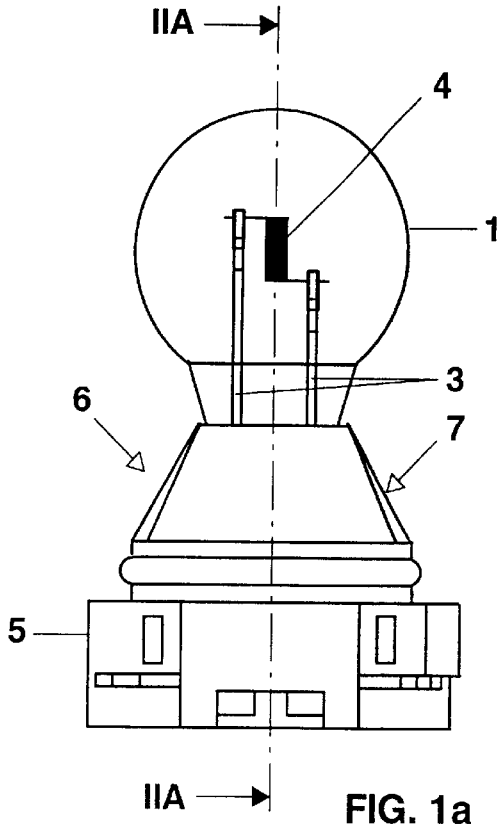
FIG. 1*a* shows, an electric lamp in side view.
Figure 1B:
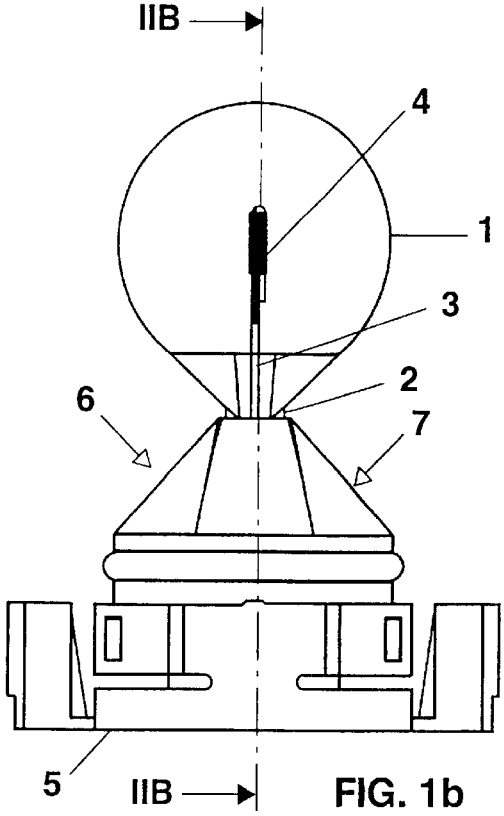
FIG. 1*b* is the electric lamp of FIG. 1*a* rotated by 90.

In FIGS. 1*a*, 1*b*, 2*a* and 2*b*, an electric lamp in accordance with a first exemplary embodiment is shown. This lamp has a lamp bulb 1 (of hard glass or quartz glass) which is closed at one end, from whose end which is closed with a pinch 2, two power supply leads 3 protrude to the outside, which are connected electrically conductively with an incandescent body 4 located inside the lamp bulb 1. The incandescent body 4 defines a vertical lamp axis A. The pinch 2 of the bulb 1 is fixed in a base 6 made of plastic. The base comprises a frustoconical upper part 7 and a substantially circular-cylindrical lower part 5 attached to it. On the top of the upper part 7 oriented toward the bulb 1, the base 6 has an upper recess 8, in which the pinch 2 of the bulb is fixed. The lower part 5, on its underside, has a lower recess 9 for receiving a peglike socket or plug part. Two spatulate electrical contact lugs 10 are located in the recess 9. These contacts made the electrical in the recess 9. These contacts make the electrical connection between the plug (not shown) and the power supply leads 3.

The lamp of the preferred exemplary embodiment described above is a brake light or turn signal lamp for a motor vehicle. This lamp is universally usable in the motor vehicle. It can be mounted as a turn signal lamp in a front headlight of the motor vehicle or as a turn signal or brake light lamp in a taillight of the motor vehicle.

The upper part and the lower part of the base can be formed integrally of a single workpiece or can be subdivided into two separate parts.

Preferably, the lamp is installed in a headlight (see FIG. 2*b*) equipped with a reflector 11. To install the lamp in the back reflector opening 12 of a motor vehicle headlight, the lamp is first secured in the upper recess 8 of the base.

Figure 2A:
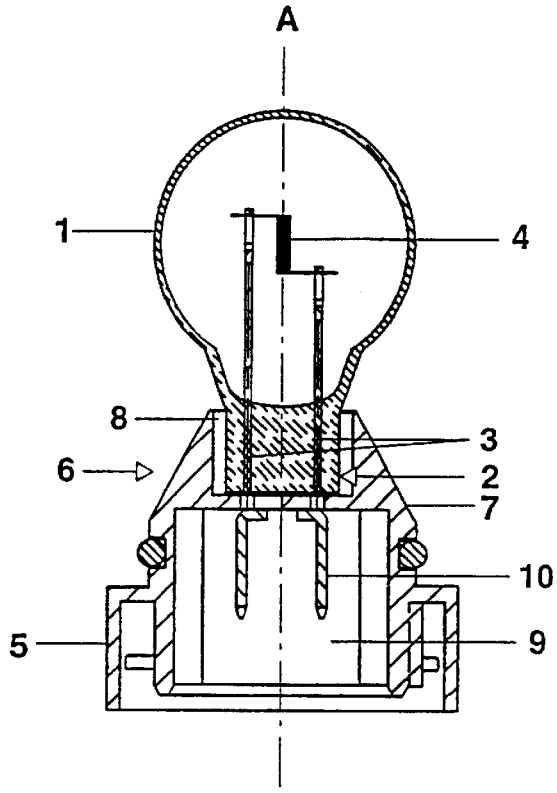
FIG. 2, the lamp of FIG. 1 in section shows in cooperation with a reflector.
Figure 2B:
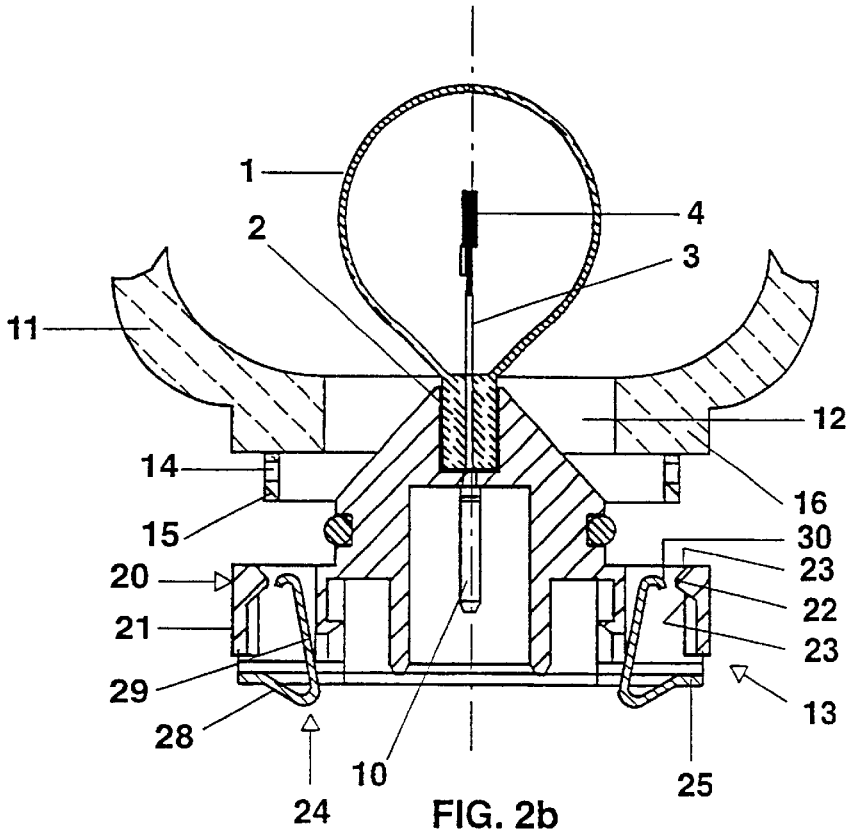
Figure 3A:
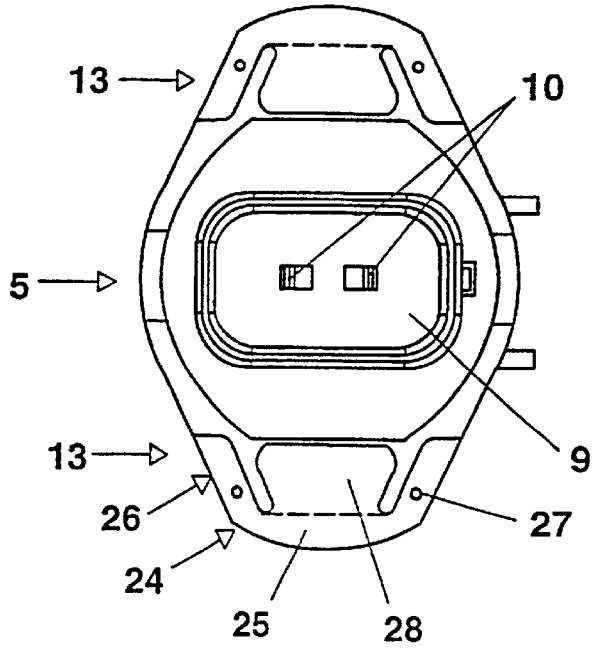
FIG. 3*a*, a bottom view of the base of the lamp

As shown in FIG. 3*a*, the lower part 5, on two opposite sides, has a respective lug part 13, which protrudes markedly toward the upper part 7. These two lugs 13 each form one detent mechanism for fastening to the reflector, or more specifically to an annular collar 15, which has two opposed, for instance rectangular, recesses 14 (see FIG. 2*b*). The collar 15 is integrally formed onto the reflector neck 16 or secured to it. The recesses 14 cooperate with the detent mechanism of the base to make a separable connection.

The detent mechanism comprises a radially outer detent protrusion 20 (FIG. 2*b*) with an axially parallel base part 21 adjoining the lower part, and a radially inward-pointing projection 22 on the free end of the base part, which is connected to the base part 21 via two chamfers 23.

Figure 3B:
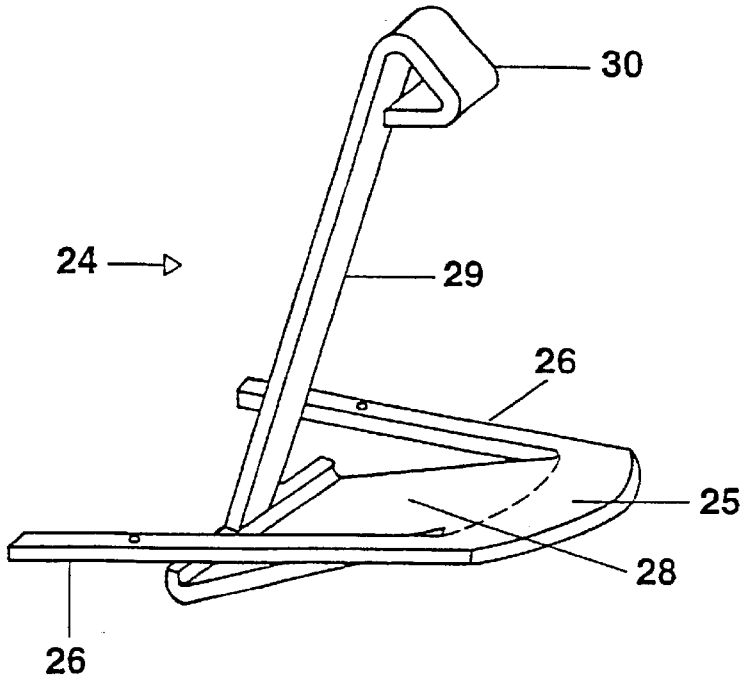
FIG. 3*b* is a perspective view of the metal spring of the lamp.

The detent protrusion 20 cooperates with a metal spring 24 of spring sheet metal facing it. It comprises a flat retainer element 25 (FIG. 3*b*), which on the outside has two fins 26 with bores 27. The latter serve as anchoring means for fastening to the underside of the lower part, for instance by ultrasonic welding, in which softened plastic material penetrates the bores 27.

Seated between the fins 26 is a first, short leg 28 of a spring part that is integrally formed onto the retainer element 25 but is bent downward, away from the bulb, out of the plane of the retainer element. The angle of inclination is approximately 30°. A second, long leg 29 is integrally formed at an acute angle onto the free end of the first leg. It pierces the plane of the retainer element and extends approximately parallel (inclined slightly outward) to the lamp axis in the direction of the bulb. A radially outward pointing projection 30 is integrally formed onto the free end of the second leg and is located approximately opposite the projection 22 of the detent protrusion 20, in spaced-apart fashion. The projection 30 is preferably bent back toward the second leg 29 (see FIG. 3*b*).

In FIG. 2*b*, the lamp is attached to the collar 15 of the reflector and thrust axially into the opening of the reflector. In the process, the two metal springs 24 with their projection 30 lock in the recess 14 of the collar. This locking can be undone again by pressing the two detent protrusions 20, seated on the outside, inward. As a result, the projections 30 are released again from the recess 14. The detent protrusion 20 is prevented by its own spring force from catching in the recess 14, since the detent protrusion springs back outward again. The chamfer 23 additionally facilitates the springing back of the detent protrusion 20.

Figure 4A:
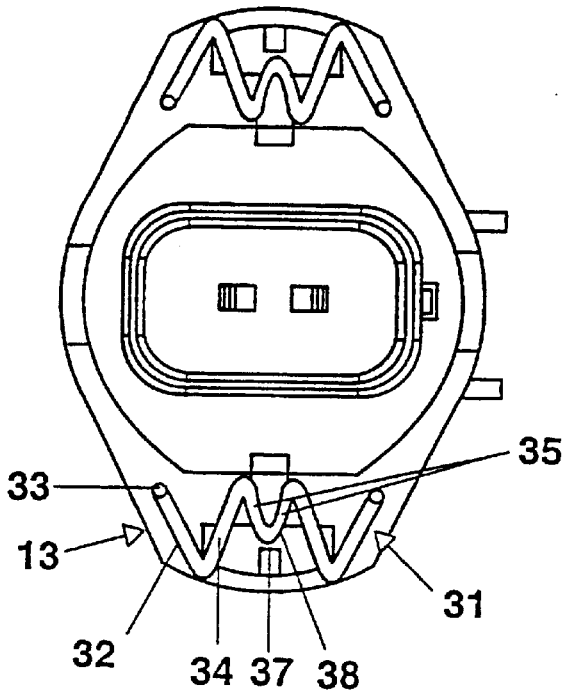
FIG. 4*a* shows, a further exemplary embodiment of a base with a spring wire piece in a plan view from below
Figure 4B:
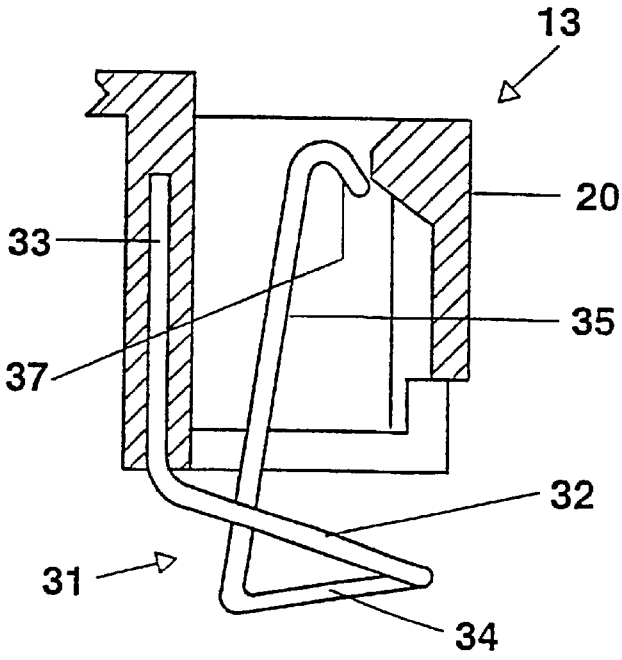
FIG. 4*b* shows the embodiment of FIG. 4*a* in section.

In a second embodiment (FIGS. 4*a* and 4*b*), the metal spring is a spring wire piece 31. It is constructed symmetrically of two halves. The retainer element is a portion which comprises a base part 32, located approximately in the plane transverse to the lamp axis, and an anchoring part 33 bent approximately 90° from it, and which is accommodated in the wall of the lower part 5 in an axially parallel bore. For the sake of better spring action, the base part 32 is inclined by about 10° from the plane of the bottom of the lower part. A short leg 34 attached to the base part is bent back by 140° toward the approximately equal-length base part 32 and merges with a long leg 35, which is attached to the short leg in such a way that it extends back again approximately axially parallel in the direction of the bulb. The two long legs 35 are connected to one another via a connecting piece 37.

Figure 5:
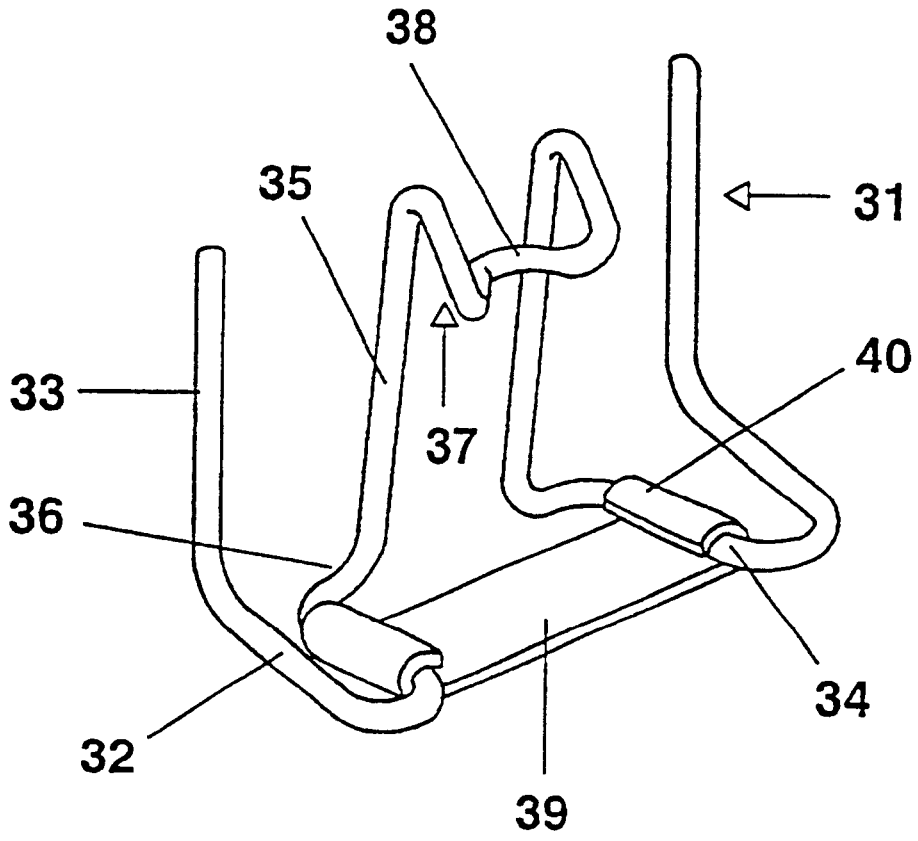
FIG. 5 a perspective view of the metal spring of FIG. 4*a*.
Figure 6A:
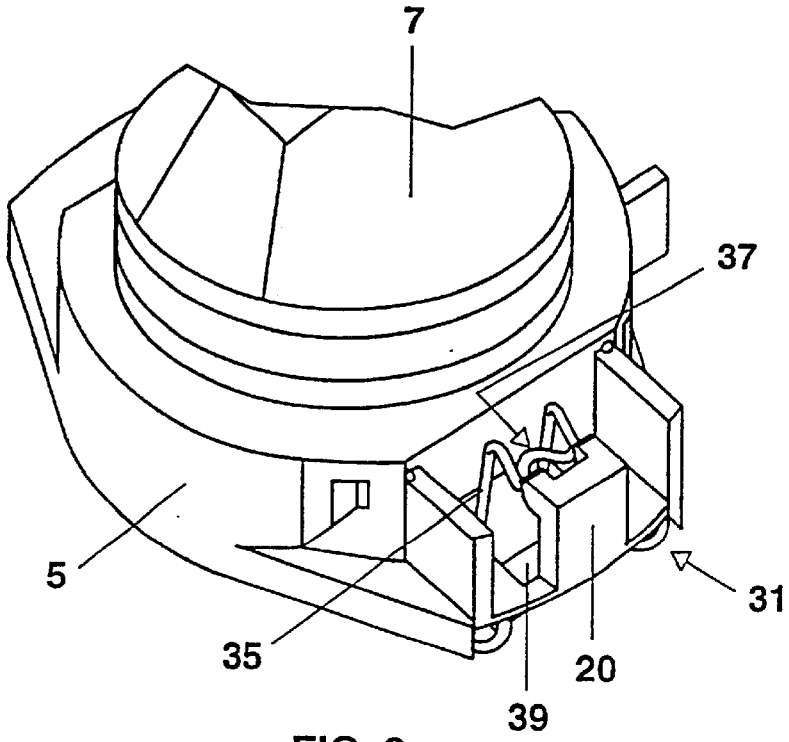
FIG. 6*a* is, a perspective view of the base of FIG. 4*a* obliquely from above.
Figure 6B:
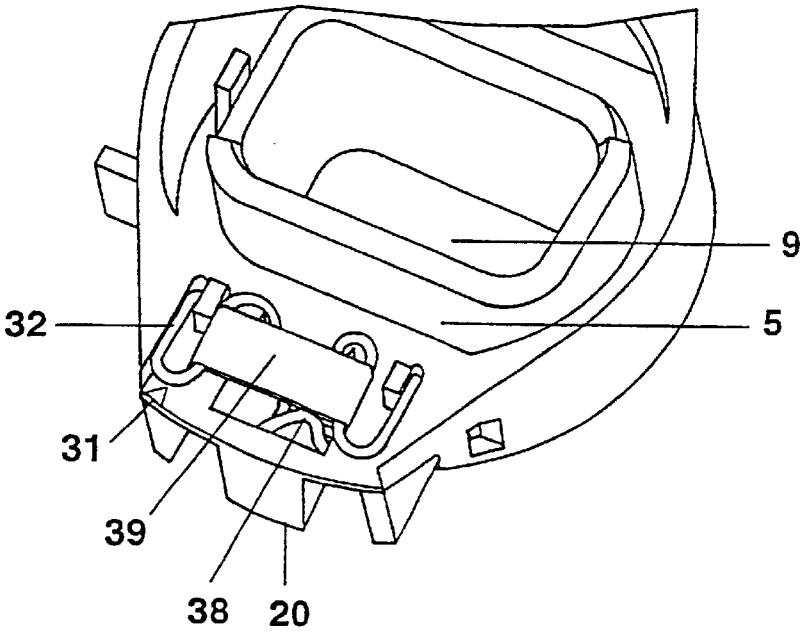
FIG. 6*b* shows the base of FIG. 4*a* obliquely from below.

In an especially preferred embodiment (FIGS. 5 and 6*a*–6*b*), the spring wire piece 31 is shaped somewhat differently. The short leg 34 attached to the base part is bent 180° back toward the approximately equal-length base part 32 and merges with a long leg 35, which is attached to the short leg via an offset bend 36 such that it extends back again approximately axially parallel in the direction of the bulb. The two long legs 35 are connected to one another via a connecting piece 37. To assure an especially secure hold of the wire in the recess 14 of the collar 15 (FIG. 2*b*), the central part of the connecting piece 37 is bent backward. This curved piece 38 is located approximately parallel to the plane of the short leg.

To further stabilize the spring wire piece 31 and additionally to gain a larger area for contact pressure, a spring sheet metal strip 39 is located between the two short legs 34, in their own plane. The ends 40 of the spring sheet metal strip are bent over around the short legs 34.

What is claimed is:

1. An electric lamp, which defines, an axis A, comprising:

a bulb (1) having a luminous filament (4), a base (6) in which the bulb is fixed and having external contacts (10), and at least two power supply leads (3) which electrically conductively connect the luminous filament to the external contacts, wherein the base is structurally subdivided into an upper part (7), which retains the bulb, and a lower part (5) for external fastening, and the lower part having an outer edge which, with respect to the axis A, radially protrudes past the upper part and the portion of the lower part which protrudes past the upper part is embodied as a detent mechanism for the external fastening, and wherein the detent mechanism comprises a detent protrusion (20) located on the outside of the lower part of the base and facing inward, which is an integral component of the lower part of the base, and a spring (24; 31) located opposite the detent protrusion and cooperating with the detent protrusion and secured in the lower part of the base, the spring being operatively selectably coupled in detent fashion in a recess (14) on a reflector (11), the detent protrusion operatively selectably uncoupling the spring from the recess of the reflector.

2. The electric lamp of claim 1, wherein the detent protrusion (20) has a radially inward-pointing projection (22) connected to a base part via two chamfers (23).

3. The electric lamp of claim 1, wherein the spring (24) comprises a retainer element connected to the lower part of the base and a spring part formed of two legs, and the retainer element is at least in part located approximately in the plane transverse to the lamp axis, and a first, short leg (28; 34) is integrally formed onto the retainer element, and a second, long leg (29; 39) is attached at an acute angle to the free end of the first leg (28; 34) in such a way that it extends approximately parallel to the lamp axis.

4. The electric lamp of claim 3, wherein and outward-pointing projection (30), which is located approximately opposite the projection (22) of the detent protrusion, is seated on the free end of the second leg.

5. The electric lamp of claim 3, wherein the spring comprises a sheet-metal spring part (19), with a flat base plate transverse to the lamp axis as a retainer element and with a spring part formed in the shape of a V of two legs (28, 29), and a first, short leg (28) is attached to the base plate and is inclined relative to the base plate, and a second, long leg (29) is attached at an acute angle to the first leg and penetrates the plane of the base plate in such a way that it is again oriented approximately parallel to the lamp axis.

6. The electric lamp of claim 3, wherein the spring comprises a spring wire piece (31), and the retainer element has a base part (32), approximately transverse to the lamp axis, and an anchoring part (33), which is attached to the base part and is oriented parallel to the lamp axis, and the short leg (34) is bent backward on the base part by more than 120°.

7. The electric lamp of claim 6, wherein the long leg (35) is attached laterally to the short leg (34), in particular with an offset bend.

8. The electric lamp of claim 6, wherein the spring wire piece (31) is constructed symmetrically of two halves, both long legs (35) of which are connected to one another via a connecting piece (37) that forms the projection.

9. The electric lamp of claim 8, wherein the connecting piece (37) has a curved piece (38) bent backward toward the second legs (35).

10. The electric lamp of claim 8, wherein the two first legs (34) are connected to one another via a stabilizing part (39).

11. The electric lamp of claim 1 wherein substantially all points along the outer edge of the lower part of the base radially protrude, with respect to axis A, past the upper part of the base.

* * * * *